US009884741B2

(12) United States Patent
Ding et al.

(10) Patent No.: US 9,884,741 B2
(45) Date of Patent: Feb. 6, 2018

(54) TELEPHONE WIRE WITHDRAWING DEVICE

(71) Applicant: GRG Banking Equipment Co., Ltd., Guangzhou, Guangdong (CN)

(72) Inventors: Yingfeng Ding, Guangdong (CN); Hexiang Huang, Guangdong (CN); Changhai Wu, Guangdong (CN); Guocheng Shi, Guangdong (CN); Guanfu Long, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/100,271

(22) PCT Filed: Nov. 24, 2014

(86) PCT No.: PCT/CN2014/092008
§ 371 (c)(1),
(2) Date: May 27, 2016

(87) PCT Pub. No.: WO2015/149529
PCT Pub. Date: Oct. 8, 2015

(65) Prior Publication Data

US 2017/0001828 A1 Jan. 5, 2017

(30) Foreign Application Priority Data

Apr. 2, 2014 (CN) ..... 2014 1 0132031

(51) Int. Cl.
*B65H 75/36* (2006.01)
*B65H 75/44* (2006.01)

(52) U.S. Cl.
CPC ..... *B65H 75/4418* (2013.01); *B65H 75/368* (2013.01); *B65H 2701/34* (2013.01)

(58) Field of Classification Search
CPC ..... B65H 75/4418; B65H 75/368; B65H 2701/34; B65H 75/36; B65H 75/44; B65H 75/4421; H02G 11/003
See application file for complete search history.

(56) References Cited

U.S. PATENT DOCUMENTS 5,421,530 A * 6/1995 Bertagna ..... B65H 75/368 242/388.91
8,740,127 B2 * 6/2014 Soper ..... B65H 75/4421 242/388.9

(Continued)

FOREIGN PATENT DOCUMENTS

CN 2462596 Y 1/2001
CN 2494084 Y 5/2002

(Continued)

OTHER PUBLICATIONS

International Search Report and Written Opinion.
European Search Report for 14888547.8-1731/3127846, dated Mar. 5, 2017.

*Primary Examiner* — William A. Rivera
(74) *Attorney, Agent, or Firm* — U.S. Fairsky LLP; Yue Xu

(57) ABSTRACT

A telephone wire withdrawing device, which is used for achieving the drawing and withdrawing functions of a telephone wire, enabling a smooth operation, thereby improving the usage experience of a user, and avoiding call distortion caused by using an electric brush because it is unnecessary to use the electric brush. The telephone wire withdrawing device in the application includes a slide block, a machine frame, a microphone, a telephone wire, a first roller, a rotating self-locking mechanism, a second roller and an extension spring, wherein the rotating self-locking mechanism is composed of a base, a gear shell, a paddle, a first resilient sheet and a second resilient sheet.

12 Claims, 7 Drawing Sheets

(56) References Cited

U.S. PATENT DOCUMENTS

| | | | | |
|---|---|---|---|---|
| 9,352,932 | B2 * | 5/2016 | Soper | B65H 75/368 |
| 2002/0166743 | A1 | 11/2002 | Liao | |
| 2008/0156922 | A1 * | 7/2008 | Rabinowitz | B65H 75/368<br>242/372 |
| 2011/0006146 | A1 * | 1/2011 | Soper | B65H 75/4421<br>242/373 |
| 2012/0175452 | A1 * | 7/2012 | Feldstein | B65H 75/368<br>242/381 |
| 2013/0068870 | A1 | 3/2013 | Feldstein et al. | |

FOREIGN PATENT DOCUMENTS

| | | | |
|---|---|---|---|
| CN | 2494566 | Y | 6/2002 |
| CN | 2507197 | Y | 8/2002 |
| CN | 201080394 | Y | 7/2008 |
| CN | 103873623 | A | 6/2014 |
| GB | 2283957 | A | 5/1995 |
| GB | 2351485 | A | 1/2001 |
| GB | 2354755 | A | 4/2001 |
| JP | 2000063047 | A | 2/2000 |

* cited by examiner

TELEPHONE WIRE WITHDRAWING DEVICE

This application is the national phase of International Application No. PCT/CN2014/092008, titled "TELEPHONE WIRE WITHDRAWING DEVICE", filed on Nov. 24, 2014, which claims Chinese Patent Application No. 201410132031.2, titled "TELEPHONE WIRE WITHDRAWING DEVICE", filed with the Chinese State Intellectual Property Office on Apr. 2, 2014, the entire disclosure of which application is incorporated herein by reference.

FIELD

The present application relates to the field of communication devices, and particularly to a telephone wire withdrawing device.

BACKGROUND

With the development of society, the demand for instant communication becomes stronger and stronger, and wired telephones play an extremely important role in the instant communication.

Generally, a telephone wire is connected to a handset of a wired telephone, and a user can move within a range limited by the length of the telephone wire while holding the telephone receiver. However, the telephone wire may bring some obstacles and troubles to the user. Therefore, there is a rotary telephone wire withdrawing device, and the exposed length of the telephone wire may be reduced by pulling and withdrawing the telephone wire, thus reducing the inconvenience caused by the telephone wire to the user to some extent.

However, it is required to use an electric brush at one end, connected to the telephone wire, of the rotary telephone wire withdrawing device, and due to a low voltage and a low current of the telephone wire, the using of the electric brush tends to cause a call distortion, and the operation of pulling and withdrawing the telephone wire in a rotatable manner is not smooth, which may degrade the user experience.

SUMMARY

A telephone wire withdrawing device is provided according to the present application, which is capable of achieving pulling and withdrawing functions of a telephone wire to smooth the operation and improve the user experience, and furthermore, since it is unnecessary to use an electric brush, the call distortion caused by using the electric brush is avoided.

A telephone wire withdrawing device is provided according to the present application, which includes:

a slider, a frame, a handset, a telephone wire, a first roller, a rotary self-locking mechanism, a second roller, and an extension spring;

the rotary self-locking mechanism includes a base, a toothed component, a swing piece, a first resilient sheet and a second resilient sheet;

the slider is fitted in a guiding slot of the frame, and is cooperatively slidable in the guiding slot;

the first roller is fixed on the slider;

the telephone wire has one end fixed on the frame, and another end rounding the first roller and connected to the handset;

the second roller is fixed to the frame;

the extension spring has one end fixed on the frame and another end rounding the second roller and connected to the slider to provide a restoring force for the slider when the slider slides cooperatively in the guiding slot;

the frame is provided with a rack-like groove, and the rack-like groove and the toothed component of the rotary self-locking mechanism constitute a gear-rack-like structure;

the base of the rotary self-locking mechanism is fixed on the slider, and when the slider slides cooperatively in the guiding slot, the toothed component of the rotary self-locking mechanism meshes with the rack-like groove of the frame and rolls in the rack-like groove of the frame to achieve a relative rotation between the toothed component and the base of the rotary self-locking mechanism;

the swing piece, the first resilient sheet and the second resilient sheet are fixed on the toothed component; and the base is provided with at least one L-shaped lug boss.

Optionally, the toothed component is provided with teeth on a rim thereof, and the toothed component meshes with the rack-like groove.

Optionally, the swing piece has a central shaft fixed on the toothed component, and the swing piece rotates on the toothed component about the central shaft.

Optionally, the swing piece is provided with a position-limiting protrusion.

Optionally, the second resilient sheet is provided with a position-limiting bump.

Optionally, the slider cooperatively slides upwards or downwards in the guiding slot.

Optionally, the base is provided with two L-shaped lug bosses, and the two L-shaped lug bosses are symmetrical about a central axis of the base.

According to the above technical solutions, it can be seen that the present application has the following advantages.

In the present application, a telephone wire withdrawing device includes a slider, a frame, a handset, a telephone wire, a first roller, a rotary self-locking mechanism, a second roller and an extension spring. Particularly, the rotary self-locking mechanism includes the base, the toothed component, the swing piece, the first resilient sheet and the second resilient sheet. The slider is fitted in the guiding slot of the frame, and slides cooperatively in the guiding slot. The first roller is fixed on the slider. The telephone wire has one end fixed on the frame, and another end rounding the first roller and connected to the handset. The second roller is fixed on the frame. The extension spring has one end fixed on the frame and another end rounding the second roller and connected to the slider to provide a restoring force for the slider when the slider slides cooperatively in the guiding slot. The frame is provided with a rack-like groove, and the rack-like groove and the toothed component of the rotary self-locking mechanism constitute a gear-rack-like structure. The base of the rotary self-locking mechanism is fixed on the slider, and when the slider slides cooperatively in the guiding slot, the toothed component of the rotary self-locking mechanism meshes with the rack-like groove of the frame and rolls in the rack-like groove of the frame to achieve a relative rotation between the base and the toothed component of the rotary self-locking mechanism. The swing piece, the first resilient sheet and the second resilient sheet are fixed on the toothed component. The base is provided with at least one L-shaped lug boss. In the present application, the telephone wire connected in the handset may slide in the guiding slot of the frame via the first roller and the slider to achieve the pulling function of the telephone wire, and with a restoring force for the slider provided by the extension spring, the withdrawing function of the telephone wire can be achieved. Furthermore, since when the slider slides cooperatively in the guiding slot, the toothed component meshes with the rack-like groove of the frame and rolls in the rack-like groove of the frame, the pulling and withdrawing operations of the telephone wire are smooth, and the user experience is improved. In addition, since it is unnecessary to use an electric brush, the call distortion caused by using the electric brush is avoided.

Figure 1:
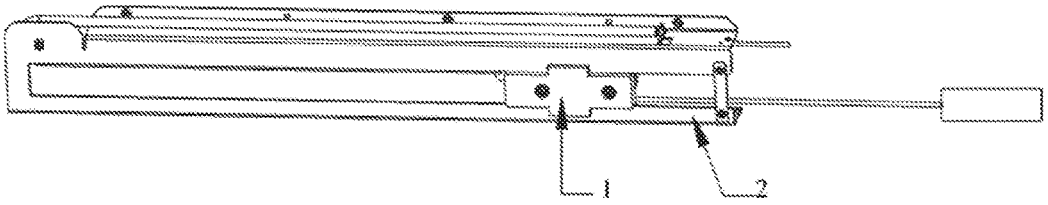
FIG. 1 is a schematic view showing the structure of an embodiment of a telephone wire withdrawing device according to the present application.

Reference numerals in Figures:

| | | | |
|---|---|---|---|
| 1 | slider, | 2 | frame, |
| 3 | handset, | 4 | telephone wire; |
| A5 | first roller, | 6 | rotary self-locking mechanism, |
| B7 | second roller, | 8 | extension spring, |
| 9 | base, | 10 | toothed component, |
| 11 | swing piece, | A12 | first resilient sheet, |
| B13 | second resilient sheet, | 14 | guiding slot, |
| 15 | rack-like groove, | 16 | L-shaped lug boss, |
| 17 | position-limiting protrusion of the swing piece 11, | | |
| 18 | position-limiting bump of the resilient sheet B13, | | |
| Y | position on the frame 2, | Z | position on the frame 2, |

-continued

| | | | |
|---|---|---|---|
| X | position on the slider 1, | V | rotation center of toothed component 10, and |
| W | rotation center of swing piece 11. | | |

DETAILED DESCRIPTION

A telephone wire withdrawing device is provided according to an embodiment of the present application, to achieve pulling and withdrawing functions of a telephone wire so as to obtain a smooth operation and improve the user experience, and further to avoid the call distortion caused by an electric brush due to the fact that the electric brush is not necessarily used by the telephone wire withdrawing device.

In order to make the objects, features and advantages of the present application be more obvious and easy to understand, the technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

Referring to FIGS. 1 to 14, an embodiment of a telephone wire withdrawing device according to the present application includes: a slider 1, a frame 2, a handset 3, a telephone wire 4, a roller A5, a rotary self-locking mechanism 6, a roller B7, and an extension spring 8.

The rotary self-locking mechanism includes a base 9, a toothed component 10, a swing piece 11, a resilient sheet A12 and a resilient sheet B13.

The slider 1 is fitted in a guiding slot 14 of the frame 2, and can slide cooperatively in the guiding slot 14.

The roller A5 is fixed on the slider 1.

Figure 2:
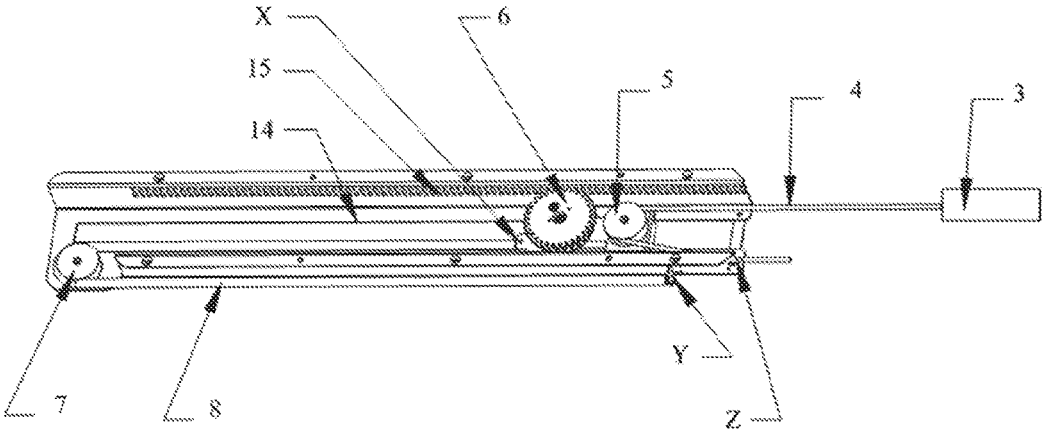
FIG. 2 is a schematic view showing the structure of an embodiment of a telephone wire withdrawing device according to the present application.
Figure 3:
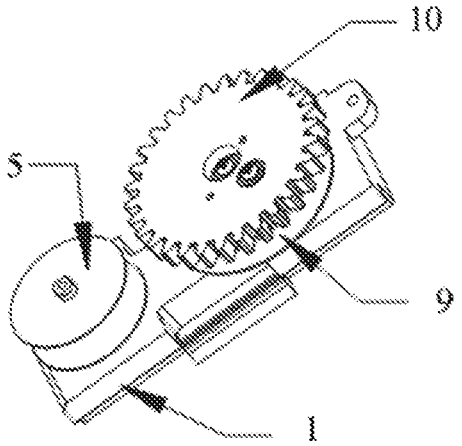
FIG. 3 is a schematic view showing the structure of a rotary self-locking mechanism of a telephone wire withdrawing device according to the present application.
Figure 4:
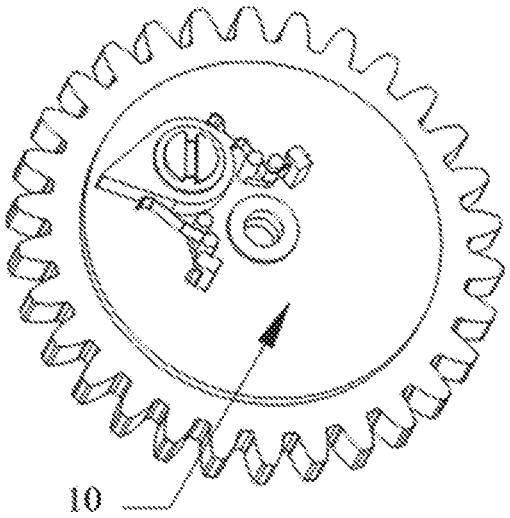
FIG. 4 is a schematic view showing the structure of a toothed component in a telephone wire withdrawing device.
Figure 5:
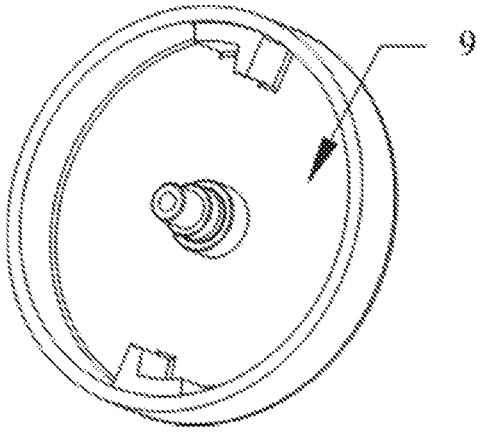
FIG. 5 is a schematic view showing the structure of a base in a telephone wire withdrawing device.

The telephone wire 4 has one end fixed on the frame 2, and another end rounding the roller A5 and connected to the handset 3. It should be noted that, as shown in FIG. 2, the telephone wire 4 may have one end fixed on a position Z on the frame 2, and another end rounding the roller A5 and being connected to the handset 3.

The roller B7 is fixed on the frame 2.

The extension spring 8 has one end fixed on the frame 2 and another end rounding the roller B7 and being connected to the slider 1, which is configured to provide a restoring force for the slider 1 in the case that the slider 1 slides cooperatively in the guiding slot 14. It should be noted that, as shown in FIG. 2, the extension spring 8 has one end fixed at a position Y on the frame 2 and another end rounding the roller B7 and being connected at the position X on the slider 1.

The frame 2 is provided with a rack-like groove 15, and the rack-like groove 15 and the toothed component 10 of the rotary self-locking mechanism 6 constitute a gear-rack-like structure.

The base 9 of the rotary self-locking mechanism 6 is fixed on the slider 1, and in the case that the slider 1 slides cooperatively in the guiding slot 14, the toothed component 10 of the rotary self-locking mechanism 6 meshes and rolls in the rack-like groove 15 of the frame 2 to achieve a relative rotation between the base 9 and the toothed component 10 of the rotary self-locking mechanism 6.

The swing piece 11, the resilient sheet A12 and the resilient sheet B13 are fixed on the toothed component 10.

It should be noted that, the toothed component 10 is provided with teeth on a rim thereof and the teeth mesh with the rack-like groove 15;

The swing piece 11 has a central shaft fixed on the toothed component 10, and the swing piece 11 rotates on the toothed component 10 about the central shaft.

The swing piece 11 is provided with a position-limiting protrusion 17.

The resilient sheet B13 is provided with a position-limiting bump 18.

The slider 1 cooperatively slides upwards or downwards in the guiding slot 14.

The base 9 is provided with two L-shaped lug bosses 16, and the two L-shaped lug bosses 16 are symmetrical about a central axis of the base 9.

(1) The drawing and withdrawing functions of the telephone wire withdrawing device according to this embodiment is performed by the following process.

As shown in FIGS. 1 and 2, the slider 1 is fitted in the guiding slot 14 of the frame 2, and the slider 1 is slidable upward or downward direction along the guiding slot 14 in the guiding slot 14 of the frame 2. Particularly, when the user picks up the handset 3, the slider 1 may slide upwardly, and when the user hangs up the handset 3, the slider 1 may drive the telephone wire 4 to move downwardly under the action of the extension spring 8.

(2) The function of achieving a fixed length of the telephone wire by the telephone wire withdrawing device according to this embodiment is performed by the following process.

Figure 6:
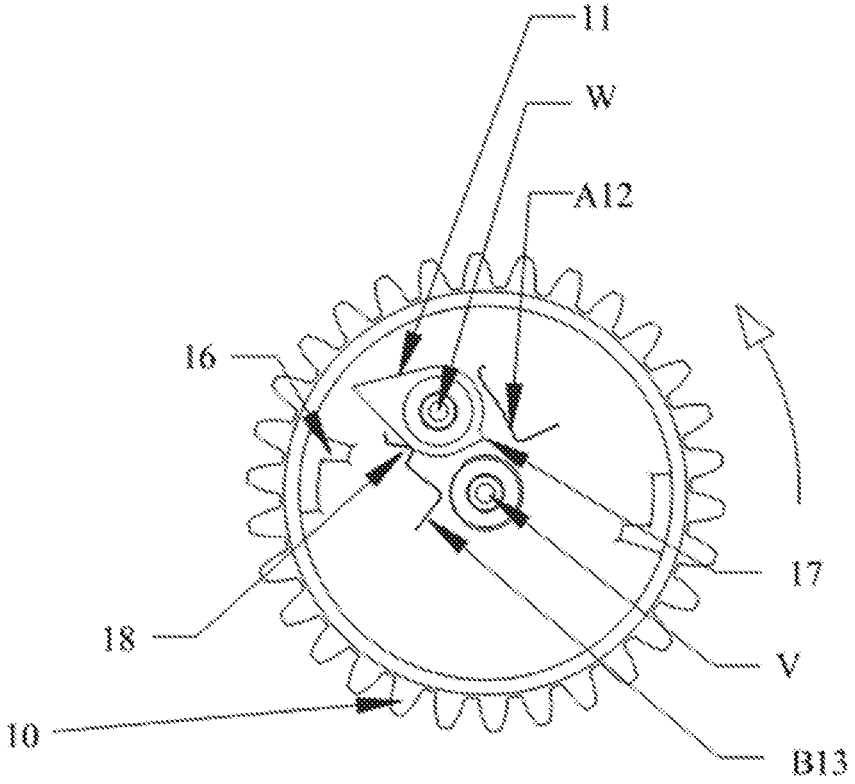
FIG. 6 is a schematic view partially showing the structures of a toothed component, a base, a resilient sheet and a swing piece in a telephone wire withdrawing device.
Figure 7:
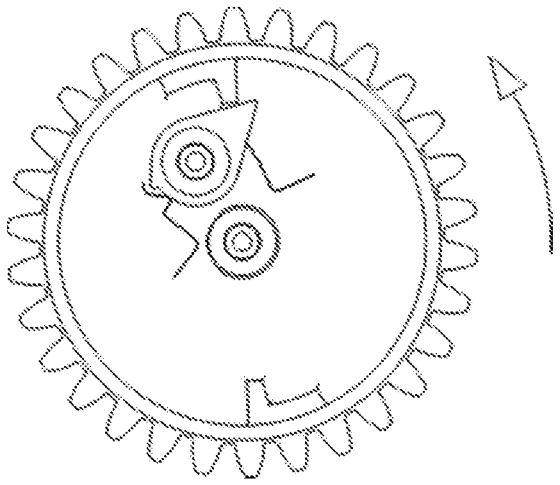
FIG. 7 is a schematic view showing a state of a toothed component, a base, a resilient sheet and a swing piece in a telephone wire withdrawing device.
Figure 8:
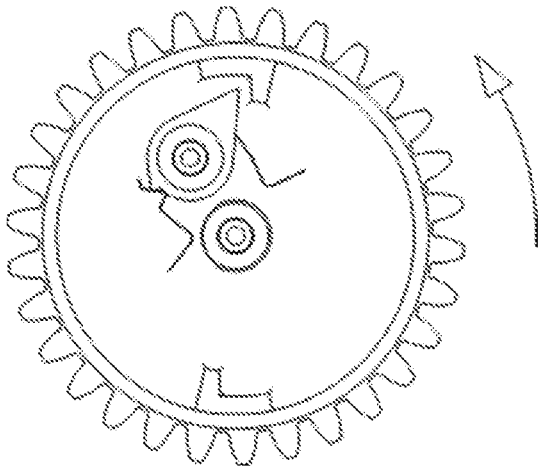
FIG. 8 is a schematic view showing another state of a toothed component, a base, a resilient sheet and a swing piece of a telephone wire withdrawing device.
Figure 9:
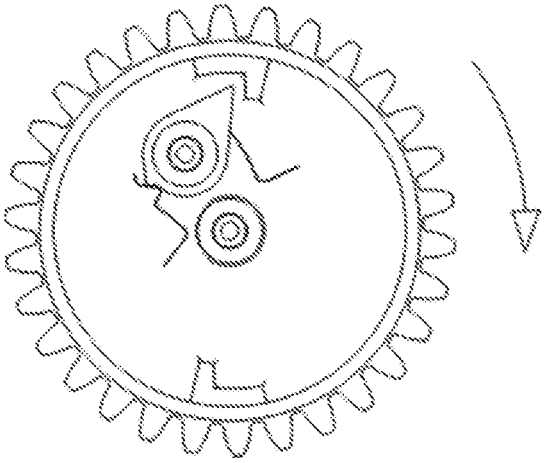
FIG. 9 is a schematic view showing another state of a toothed component, a base, a resilient sheet and a swing piece of a telephone wire withdrawing device.
Figure 10:
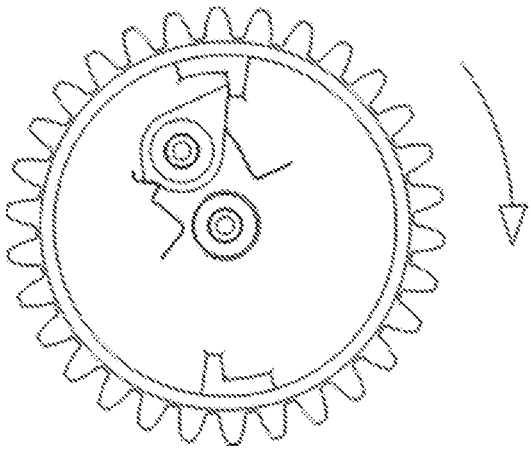
FIG. 10 is a schematic view showing another state of a toothed component, a base, a resilient sheet and a swing piece of a telephone wire withdrawing device.
Figure 11:
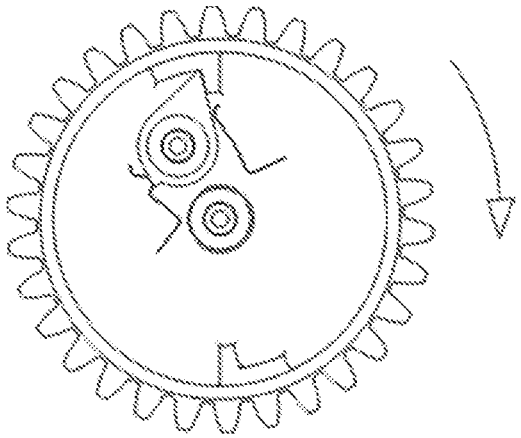
FIG. 11 is a schematic view showing another state of a toothed component, a base, a resilient sheet and a swing piece of a telephone wire withdrawing device.

As shown in FIG. 2, when the user picks up the handset 3, the slider 1 may slide upwardly, and a length of the telephone wire 4 being drawn out may be increased. The toothed component 10 may drive the swing piece 11 to counterclockwise rotate about a center of rotation V under the action of the gear-rack-like structure. Reference is made in FIGS. 6, 7 and 8. In FIG. 6, the swing piece 11 is in a free state and is freely rotatable about a rotation center W. In the case that the toothed component 10 drives the swing piece 11 to counterclockwise rotate and reaches a state shown in FIG. 7, the L-shaped lug boss 16 of the base 9 may press down the swing piece 11, the resilient sheet A12 provides a supporting force for the swing piece 11, and the limiting position protrusion of the swing piece 11 may be rotated to a position above the limiting position bump of the resilient sheet B13. When the swing piece 11 rotates counterclockwise and reaches a state shown in FIG. 8, the position-limiting protrusion 17 of the swing piece 11 may abut against the position-limiting bump 18 of the resilient sheet B13 under the action of the supporting force of the resilient sheet A12. When the user continues to pull out the telephone wire 4, the rotary self-locking mechanism 6 may repeat the states shown in FIGS. 7 and 8 and may not be locked. When the handset 3 is released by the user, the telephone wire 4 may also be released, and the slider 1 may drive the rotary self-locking mechanism 6 to move downwardly under the restoring force of the extension spring 8. Also, a length of the telephone wire 4 being pulled out may be shortened to some extent. In such a case, the toothed component 10 may drive the swing piece 11 to rotate clockwise under the action of the gear-rack-like structure. As shown in FIGS. 9, 10 and 11, in the case that the toothed component 10 drives the swing piece 11 to rotate clockwise, the swing piece 11 may contact with the L-shaped lug boss 16 of the base 9, and reaches a state shown in FIG. 11 under the action of a rotating force. In such case, the position-limiting bump 18 of the resilient sheet B13 presses on the position-limiting protrusion 17 of the swing piece 11 and provides a supporting force for the swing piece 11, thus preventing the swing piece 11 from continuing to rotate clockwise and accordingly preventing the resilient sheet B13, the resilient sheet A12 and the toothed component 10 from rotating clockwise, and the swing piece 11 and the toothed component 10 are in a clockwise self-locking state. At this moment, the slider 1 may be fixed at a certain position in the guiding slot 14 of the frame 2 under a combined action of the extension spring 8 and the self-locking state of the rotary self-locking mechanism 6. In this case, the telephone wire 4 at the handset end may have a certain fixed length to allow the user to freely move during calls, thus providing a better calling experience for the user.

(3) The function of automatic withdrawing of the telephone wire by the telephone wire withdrawing device according to this embodiment is specifically performed by the following process.

Figure 12:
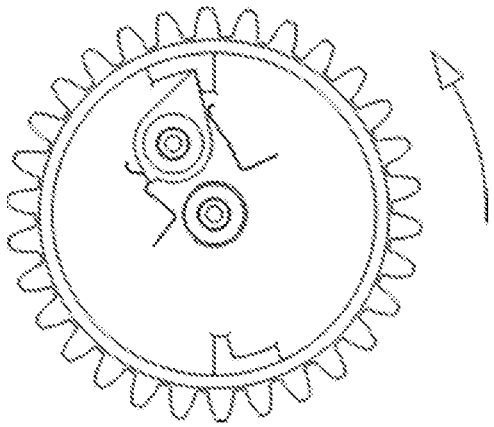
FIG. 12 is a schematic view showing another state of a toothed component, a base, a resilient sheet and a swing piece of a telephone wire withdrawing device.
Figure 13:
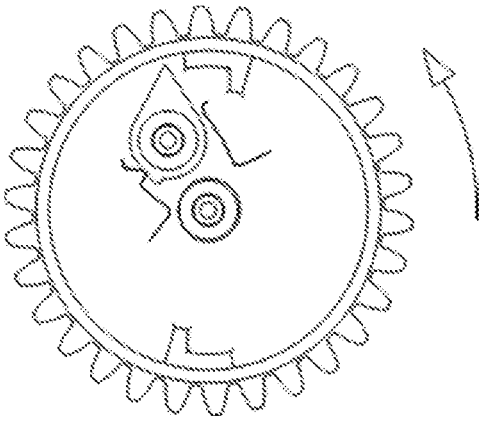
FIG. 13 is a schematic view showing another state of a toothed component, a base, a resilient sheet and a swing piece of a telephone wire withdrawing device.
Figure 14:
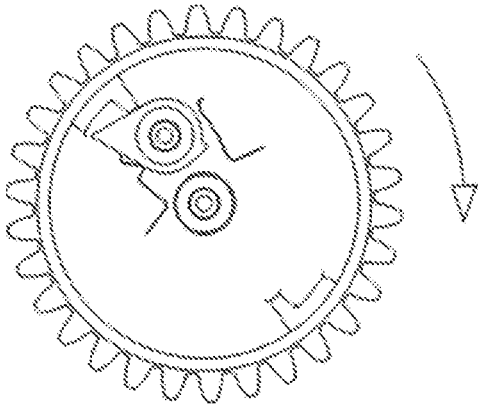
FIG. 14 is a schematic view showing another state of a toothed component, a base, a resilient sheet and a swing piece of a telephone wire withdrawing device.

As shown in FIG. 2, after the user finishes the call, the user may slightly pull the telephone wire 4 upwardly to straighten the telephone wire 4 and bring the slider 1 to move upwardly by a short distance. Then, the toothed component 10 may drive the swing piece 11 to rotate counterclockwise under the action of the gear-rack-like structure. As shown in FIG. 12, when the mechanism reaches a state shown in FIG. 12, the position-limiting bump 18 of the resilient sheet B13 is pressed on the position-limiting protrusion 17 of the swing piece 11 to provide a force for rotating the swing piece 11 counterclockwise, and the swing piece 11 may rotate counterclockwise by a certain degree under the force provided by the resilient sheet B13 and then rotates to a state shown in FIG. 13. At this moment, if the user hangs up the handset 3, the slider 1 may drive the telephone wire 4 to move downwardly under the action of the extension spring 8, and the toothed component 10 may drive the swing piece 11 to rotate clockwise under the action of the gear-rack-like structure. As shown in FIG. 14, the L-shaped lug boss 16 of the base 2, and the swing piece 11 may not limit the downward movement of the slider 1, thus achieving the automatic withdrawing function of the telephone wire.

In this embodiment, a telephone wire withdrawing device includes a slider 1, a frame 2, a handset 3, a telephone wire 4, a roller A5, a rotary self-locking mechanism 6, a roller B7 and an extension spring 8. The rotary self-locking mechanism includes a base 9, a toothed component 10, a swing piece 11, a resilient sheet A12, and a resilient sheet B13. The slider 1 is fitted in the guiding slot 14 of the frame 2, and slides cooperatively in the guiding slot 14. The roller A5 is fixed on the slider 1. The telephone wire 4 has one end fixed on the frame 2, and another end rounding the roller A5 and connected in the handset 3. The roller B7 is fixed on the frame 2. The extension spring 8 has one end fixed on the frame 2, and has another end rounding the roller B7 and connected on the slider 1 to provide a restoring force for the slider 1 in the case that the slider 1 slides cooperatively in the guiding slot 14. The frame 2 is provided with a rack-like groove 15, and the rack-like groove 15 and the toothed component 10 of the rotary self-locking mechanism 6 constitute a gear-rack-like structure. The base 9 of the rotary self-locking mechanism 6 is fixed on the slider 1, and in the case that the slider 1 slides cooperatively in the guiding slot 14, the toothed component 10 of the rotary self-locking mechanism 6 meshes and rolls in the rack-like groove 15 of the frame 2 to realize a relative rotation between the base 9 and the toothed component 10 of the rotary self-locking mechanism 6. The swing piece 11, the resilient sheet A12 and the resilient sheet B13 are fixed on the toothed component 10. The base 9 is provided with at least one L-shaped lug boss 16. In this embodiment, the telephone wire 4 connected to the handset 3 may slide in the guiding slot 14 of the frame 2 via the roller A5 and the slider 1 to realize the pulling function of the telephone wire, and with a restoring force for the slider 1 provided by the extension spring 8, the withdrawing function of the telephone wire may be achieved. Furthermore, since when the slider 1 slides cooperatively in the guiding slot 14, the toothed component 10 meshes and rolls in the rack-like groove 15 of the frame 2, the operations during drawing and withdrawing of the telephone wire 4 are smooth, thus improving the user experience. In addition, since it is unnecessary to use an electric brush, the call distortion caused by the electric brush is avoided. Moreover, a telephone wire withdrawing device according to this embodiment realizes the function of achieving a fixed length of the telephone wire and the function of automatic withdrawing of the telephone wire, thereby providing a better user experience.

A telephone wire withdrawing device according to this embodiment has the advantages of a simple structure, an easy maintenance, a high reliability, a simple operation, a safety design and a low cost. The telephone wire have a variable fixed length and can realize the automatic withdrawing function, thus is very suitable to apply to a calling device in the public place with a harsh service environment.

For ease of understanding, a telephone wire withdrawing device according to an embodiment of the present application used in a practical application scenario is described hereinafter according to the embodiments shown in FIGS. 1 to 14.

A: When a user picks up the handset 3, the slider 1 may slide upwardly, and a length of the telephone wire 4 being pulled out may be increased.

B: When the user pulls out the handset 3 by an appropriate length, the user stops pulling out the telephone wire 4, at this moment under the action of the rotary self-locking mechanism 6, this appropriate length of the telephone wire 4 is maintained, and the telephone wire is brought into a locking state, thus the telephone wire 4 cannot be withdrawn any more.

C: When the user makes a call via the handset 3 and needs to withdraw the telephone wire 4 after ending the call, the user holds the handset 3 and pulls out the telephone wire 4 by a short distance, then the user moves handset 3 in the withdrawing direction, at this moment, the locking state of the rotary self-locking mechanism 6 is released.

D: After the locking state is released, the user continues to move the handset 3 in the withdrawing direction, and the telephone wire 4 is gradually withdrawn until the telephone wire 4 is withdrawn to an initial length. Then, the user hangs up the handset 3 and the calling process finishes.

Those skilled in the art may clearly understand that, for a convenient and simple description, the specific operation process of the system, the device and the unit described above may refer to the corresponding process in the above embodiments of the method, thus is not described in detail hereinafter.

In the several embodiments according to the present application, it should be appreciated that, the method, the device and the system disclosed herein may be implemented in other manners. For example, the embodiments of the device described above are only schematic. For example, the division of the units is only a division according to the logical functions, and there may be other division modes in the practical implementation, for instant, multiple units or components may be combined, or may be integrated into another system, or some features may be omitted or may be not performed. In addition, the coupling, direct coupling or communication connection between the components displayed or discussed above may be realized by some interfaces. The indirect coupling or communication connection between the devices or units may be electrical, mechanical or be of other forms.

The above unit described as a separate component may be or may be not physically separate. The component displayed as a unit may be or may be not a physical unit, that is, may be located at one place or may be distributed on multiple network units. The object of the solution of the embodiment may be achieved by selecting a part or all of the units according to the practical demands.

Furthermore, various function units in the embodiments of the present application may be integrated in one processing unit; or, each of the function units may be a single unit; or two or more function units are integrated in one unit. The above integrated unit may be realized in the form of hardware or in the form of software function unit.

In the case that the integrated unit is implemented in the form of software function unit and is sold or used as a separate product, it can also be stored in a computer readable storage medium. Based on such understanding, the essence of the technical solutions of the present application, or the part that contributes to the conventional technology, or all or part of the technical solutions of embodiments of the present application may be embodied in the form of a software product. The computer software product is stored in a storage medium, and includes several instructions which enables a computer device (which may be a personal computer, a server, or a network device, etc.) to execute all or part steps of the method of each embodiment of the present application. The storage medium described above includes various medium which may store program codes, such as a USB disk, a mobile hard disk drive, a Read-Only Memory (ROM), a Random Access Memory (RAM), a magnetic disc or an optical disc.

The above embodiments are only intended for describing the technical solutions of the present application, and should not be interpreted as limitation to the present application. Although the present application is described in detail in conjunction with the above embodiments, it should be understood that, for those skilled in the art, modifications may be made to the technical solutions of the above embodiments, or equivalent substitutions may be made to part or all of the technical features in the technical solutions; and theses modifications and substitutions made to the essence of the corresponding technical solution also fall into the spirit and scope defined by the technical solution of the present application.

The invention claimed is:

1. A telephone wire withdrawing device, comprising a slider, a frame, a handset, a telephone wire, a first roller, a rotary self-locking mechanism, a second roller, and an extension spring, wherein the rotary self-locking mechanism comprises a base, a toothed component, a swing piece, a first resilient sheet, and a second resilient sheet;

the slider is fitted in a guiding slot of the frame, and slides cooperatively in the guiding slot;

the first roller is fixed to the slider;

the telephone wire has one end fixed on the frame and another end rounding the first roller and being connected to the handset;

the second roller is fixed to the frame;

the extension spring has one end fixed to the frame and another end rounding the second roller and being connected to the slider, and provides a restoring force for the slider when the slider slides cooperatively in the guiding slot;

the frame is provided with a rack-shaped groove, and the rack-shaped groove and the toothed component of the rotary self-locking mechanism constitute a gear and rack structure;

the base of the rotary self-locking mechanism is fixed on the slider, and when the slider slides cooperatively in the guiding slot, the toothed component of the rotary self-locking mechanism meshes with the rack-like groove of the frame and rolls in the rack-like groove of the frame to realize a relative rotation between the toothed component and the base of the rotary self-locking mechanism;

the swing piece, the first resilient sheet and the second resilient sheet are fixed on the toothed component; and the base is provided with at least one L-shaped lug boss.

2. The telephone wire withdrawing device according to claim 1, wherein teeth are provided on a rim of the toothed component, and the toothed component meshes with the rack-shaped groove.

3. The telephone wire withdrawing device according to claim 2, wherein the base is provided with two L-shaped lug bosses, and the two L-shaped lug bosses are symmetrical about a central axis of the base.

4. The telephone wire withdrawing device according to claim 1, wherein the swing piece has a central shaft fixed on the toothed component, and the swing piece rotates about the central shaft at the toothed component.

5. The telephone wire withdrawing device according to claim 4, wherein the base is provided with two L-shaped lug bosses, and the two L-shaped lug bosses are symmetrical about a central axis of the base.

6. The telephone wire withdrawing device according to claim 1, wherein the swing piece is provided with a position-limiting protrusion.

7. The telephone wire withdrawing device according to claim 6, wherein the base is provided with two L-shaped lug bosses, and the two L-shaped lug bosses are symmetrical about a central axis of the base.

8. The telephone wire withdrawing device according to claim 1, wherein the second resilient sheet is provided with a position-limiting bump.

9. The telephone wire withdrawing device according to claim 8, wherein the base is provided with two L-shaped lug bosses, and the two L-shaped lug bosses are symmetrical about a central axis of the base.

10. The telephone wire withdrawing device according to claim 1, wherein the slider cooperatively slides upwards or downwards in the guiding slot.

11. The telephone wire withdrawing device according to claim 10, wherein the base is provided with two L-shaped lug bosses, and the two L-shaped lug bosses are symmetrical about a central axis of the base.

12. The telephone wire withdrawing device according to claim 1, wherein the base is provided with two L-shaped lug bosses, and the two L-shaped lug bosses are symmetrical about a central axis of the base.

* * * * *